US006227091B1

(12) United States Patent
Grossmann et al.

(10) Patent No.: US 6,227,091 B1
(45) Date of Patent: May 8, 2001

(54) OUTER-TURN TRIMMER FOR WIRE COILS ON HOOK CONVEYOR

(75) Inventors: Erich Grossmann, Tönisvorst; Henning Schneider, Krefeld, both of (DE)

(73) Assignee: SMS Schloemann-Siemag AG, Dusseldorf (DE)

( * ) Notice: Subject to any disclaimer, the term of this patent is extended or adjusted under 35 U.S.C. 154(b) by 0 days.

(21) Appl. No.: 09/413,359

(22) Filed: Oct. 6, 1999

(30) Foreign Application Priority Data

Oct. 7, 1998 (DE) ..... 198 46 101

(51) Int. Cl.[7] ..... B26D 5/06
(52) U.S. Cl. ..... 83/425.2; 83/907; 72/203
(58) Field of Search ..... 83/424, 425, 425.2, 83/907, 13, 40, 42; 72/203

(56) References Cited

U.S. PATENT DOCUMENTS 3,585,887 * 6/1971 Gerhard ..... 83/907
3,756,289 * 9/1973 Rotert et al. ..... 83/907
3,838,617 * 10/1974 Felker ..... 83/907

* cited by examiner

*Primary Examiner*—W. Donald Bray
(74) *Attorney, Agent, or Firm*—Herbert Dubno; Andrew Wilford

(57) ABSTRACT

A hook conveyor moves a succession of coils having outer turns through a trimming station in a transport direction with each coil lying at the station in a plane generally parallel to the direction. A trimming apparatus has a pair of supports flanking the conveyor at the station and each movable between outer and inner positions, respective guides on the supports defining respective vertical guide planes generally parallel to the direction, and respective shears movable on the guides long the respective guide planes. Respective actuators displace the shears along the respective planes and, in the inner positions of the respective supports, cut the outer turns from a coil in the station. Respective separating wedges are displaceable on the guides generally radially of the coil in the station to separate the respective outer turns from the coil. Furthermore respective stripper rods carried on the supports are each displaceable between upper and inner positions engaging the coil in the station and lower and outer positions so that the rods pull the cut outer turns from the coil in the station on displacement from the respective inner to outer positions. These rods have hooked inner ends.

8 Claims, 3 Drawing Sheets

OUTER-TURN TRIMMER FOR WIRE COILS ON HOOK CONVEYOR

FIELD OF THE INVENTION

The present invention relates to the manufacture of bar or wire. More particularly this invention concerns a trimming apparatus for cutting the outer turns off coils being transported on respective hooks of a conveyor.

BACKGROUND OF THE INVENTION

Wire or rod is typically made by a combined rolling/drawing process to produce large coils that are themselves subject to batch-type treatments, for instance annealing. To this end the coils are typically transported on heavy-duty hook conveyors having a succession of hooks on each of which is suspended a respective wire coil. The conveyor extends through the various treatment stations for the bar or wire.

The system which produces the bars or wires formed into the coils normally treats the starting and trailing end of the material somewhat roughly. Furthermore in a drawing operation the starting and trailing ends are typically offsize. Thus these pieces must be cut from the material.

Typically this is done immediately upstream of the machine that forms the material into one or more coils and deposits the coils on a loop conveyor belt. A high-speed shear is used which must not interfere with the rapid loading of the still-hot rod or wire into the coiler, since the stock must be coiled hot. Alternately it has been proposed to cut the ends off after the coil is formed, on the conveyor belt, but this is fairly tricky, especially with respect to getting the offcuts out of the way, that is off the conveyor. Similar disruptions are encountered when a so-called sickle shear is used right in the coiler.

Thus recourse is often had to a system where two workers operating power shears clip the outside turns off the coils when they are on the hook conveyor. Such a manual procedure is extremely costly and requires skilled machine operators who must cut through the material and then pull off the unwanted turns.

OBJECTS OF THE INVENTION

It is therefore an object of the present invention to provide an improved system for trimming the ends of a coils.

Another object is the provision of such an improved system for trimming the ends of a coiled wire which overcomes the above-given disadvantages, that is which is simple and automatic, and that effectively gets the trimmed-off pieces away from the production line.

SUMMARY OF THE INVENTION

A hook conveyor passes a succession of coils having outer turns through a trimming station in a transport direction with each coil lying at the station in a plane generally parallel to the direction. A trimming apparatus has according to the invention a pair of supports flanking the conveyor at the station and each movable between outer and inner positions, respective guides on the supports defining respective vertical guide planes generally parallel to the direction, and respective shears movable on the guides along the respective guide planes. Respective actuators displace the shears along the respective planes and, in the inner positions of the respective supports, cut the outer turns from a coil in the station.

This system can automatically cut through the outer turns and then separate them from the coils wholly without human intervention. As a result of the two different shears, the bad outer turns will be removed from the coils that can then be sent for further handling, for instance strapping into salable bundles.

According to the invention respective separating wedges are displaceable on the guides generally radially of the coil in the station to separate the respective outer turns from the coil. Furthermore respective stripper rods carried on the supports are each displaceable between upper and inner positions engaging the coil in the station and lower and outer positions so that the rods pull the cut outer turns from the coil in the station on displacement from the respective inner to outer positions. These rods have hooked inner ends.

An upwardly open waste chute is provided in the station between the supports. This chute is formed by a pair of upwardly diverging plates beneath the conveyor in the station.

In accordance with the invention a pair of such shears offset in the plane from each other are provided on each support. The shears of each pair are asymmetrical with respect to the vertical. Thus the cut turns will be sure to drop off the conveyor hook.

The shears and their actuators may be mounted on the machine housing.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
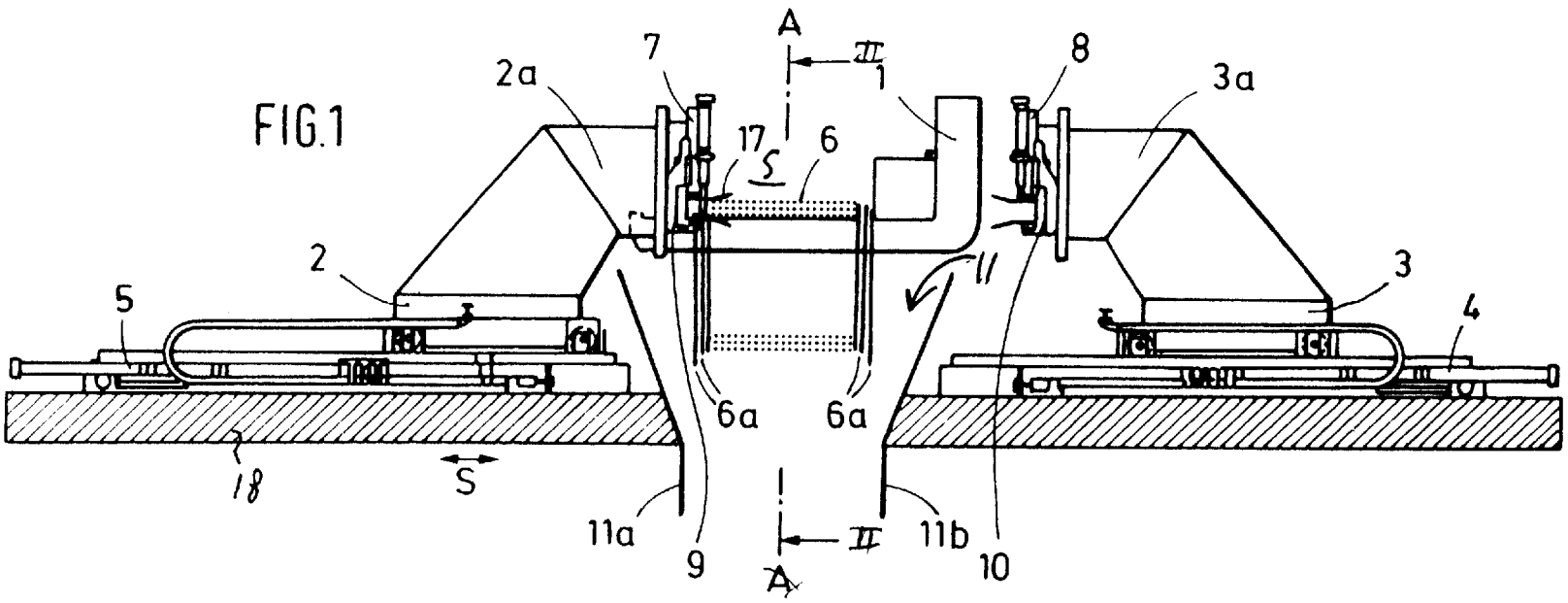
FIG. 1 is a small-scale and partly diagrammatic side view of the trimming system of this invention.
Figure 2:
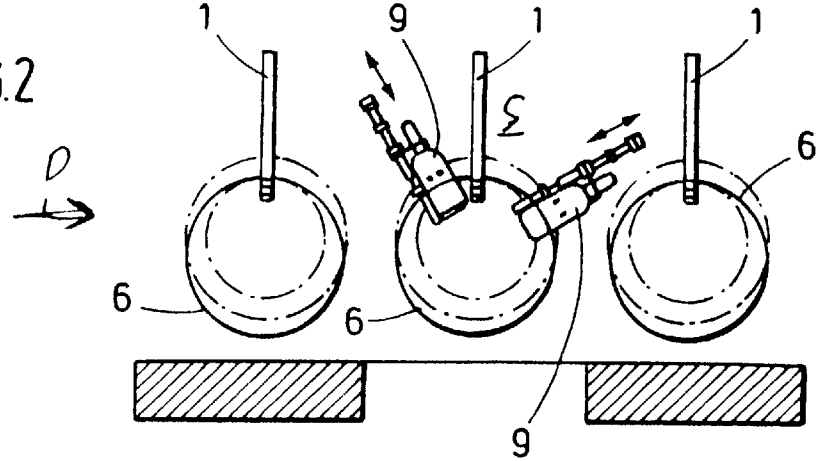
FIG. 2 is a section taken along line II—II of FIG. 1.
Figure 5:
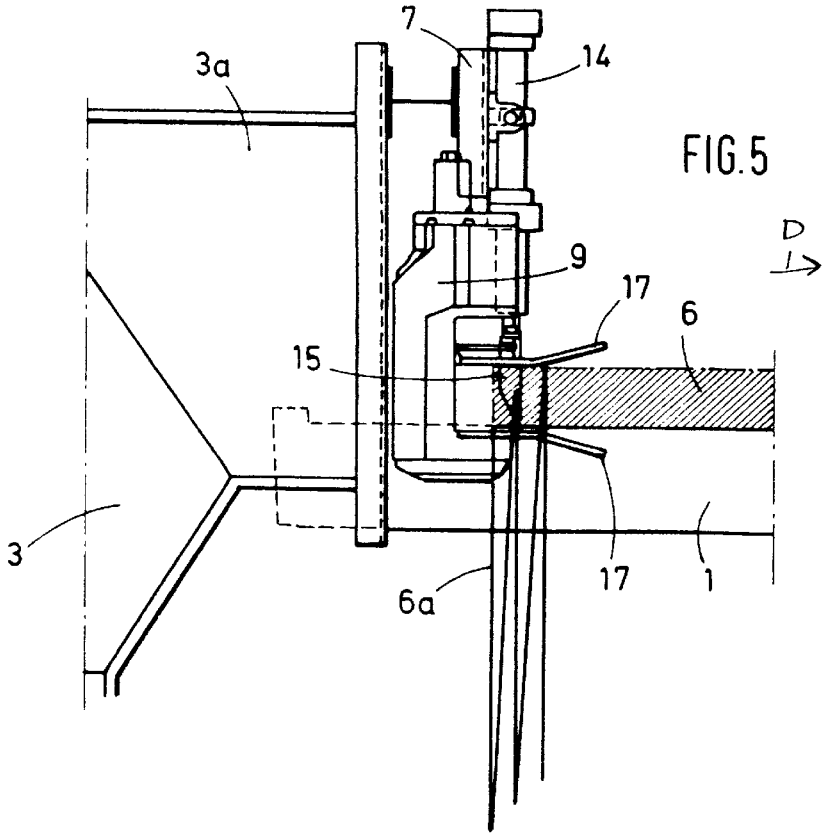
FIG. 5 is a large-scale view of a detail of FIG. 1.

As seen in FIGS. 1, 2, and 5 a conveyor is comprised of a succession of conveyor hooks 1 lying in respective planes perpendicular to a horizontal travel or transport direction D. Supports 2 and 3 are displaceable on a base 18 in a station S along the path of the conveyor hooks 1 by respective horizontal actuators 4 and 5 for horizontal movement perpendicular to the direction D and flanking the row of hooks 1 have support arms 2*a* and 2*b* with vertical guides 7 and 8 carrying respective pairs of shears 9 and 10 for cutting outer turns 6*a* off coils 6 carried on the hooks 1 between the supports 2 and 3. The pairs of shears 9 and 10 asymmetrically flank the hook 1 in the station S between them as shown in FIG. 2, with each shear 9 or 10 acting generally radially of the respective annular coils 6 which are centered on respective horizontal axes perpendicular to the direction D.

Underneath the shears 9 and 10 in the station S is an upwardly open disposal chute 11 that is formed by a pair of outwardly angled walls 11*a* and 11*b* and that serves to catch the outer turns 6*a* as they drop off the ends of the coil 6. The shears 9 and 10 of each pair of shears are oriented asymmetrically relative to the vertical to both sides of the hook 1 in the station S to ensure that no pieces will be left hanging on the hooks 1 after the cutting operation. Next to each pair of shears 9 and 10 as shown in FIG. 5 there are separating wedges 15 and respective funnel-like bent guide plates 17.

Figure 3:
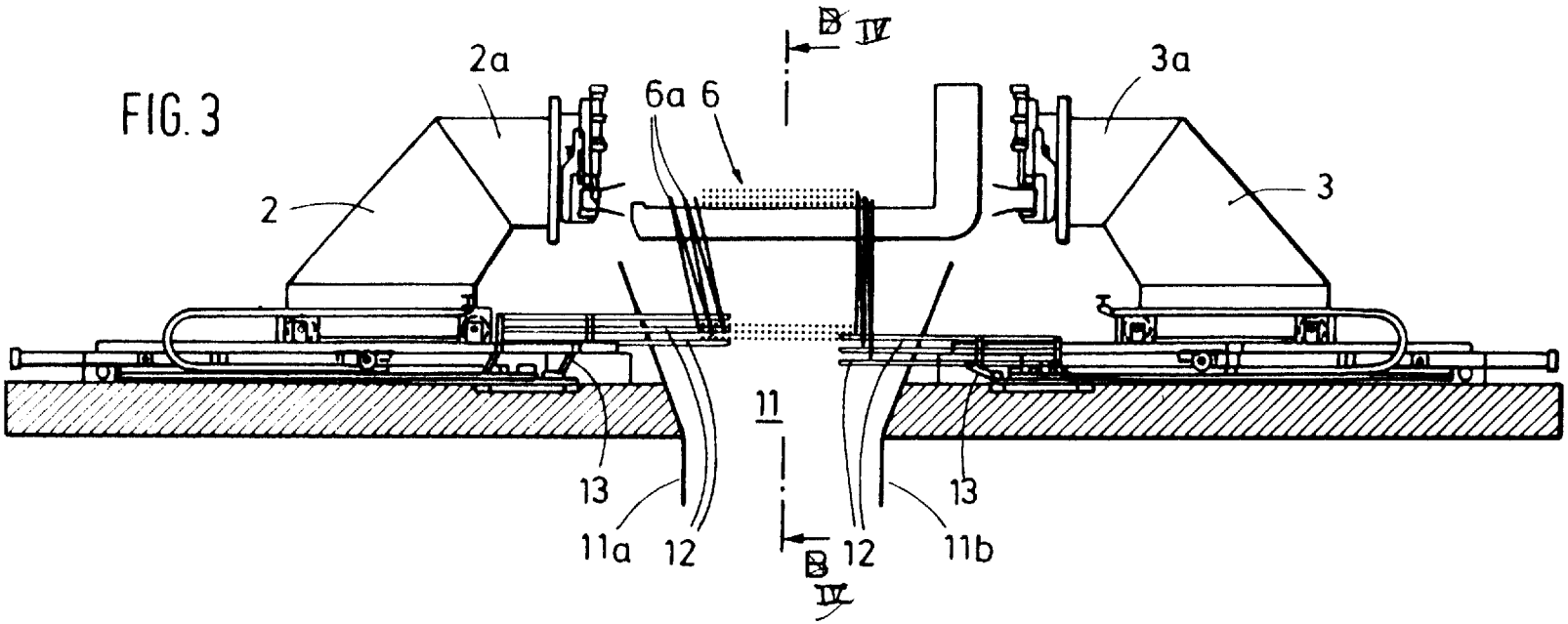
FIG. 3 is a view like FIG. 1 of another trimming system according to the invention.
Figure 4:
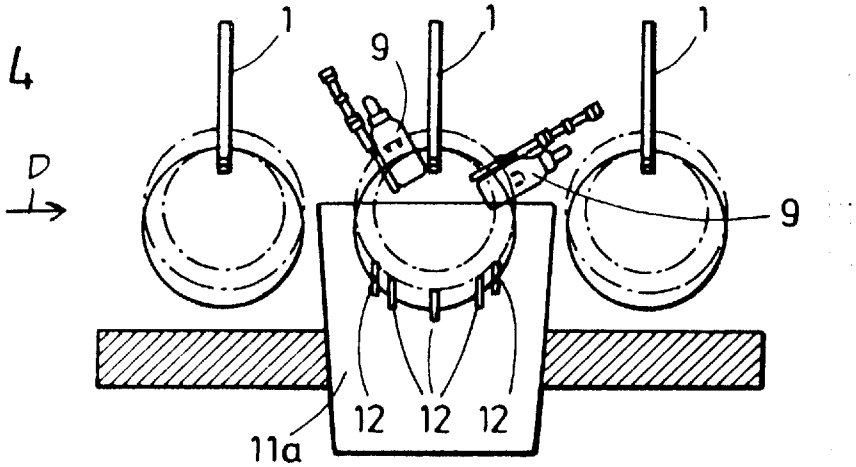
FIG. 4 is a section taken along line IV—IV of FIG. 3.
Figure 6:
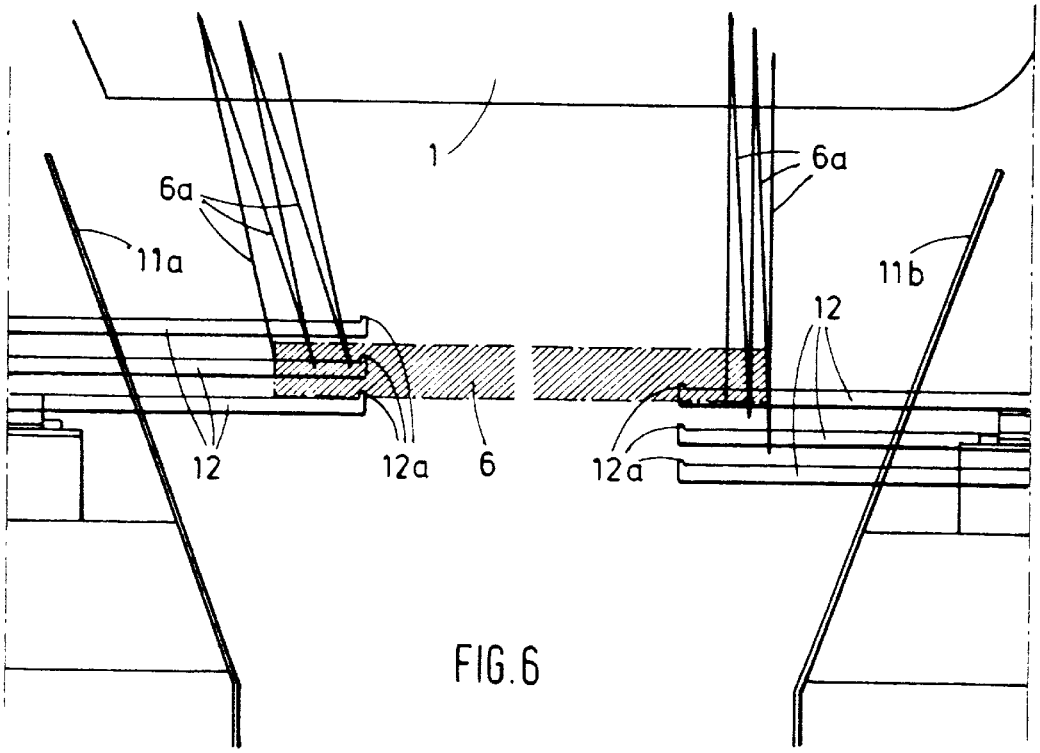
FIG. 6 is a large-scale view of a detail of FIG. 3.

In the arrangement of FIGS. 3, 4, and 6 which is otherwise similar to that of FIGS. 1 and 2, the support slides 2 and 3 carry stripper rods 12 that can be moved through respective slots in the plates 11*a* and 11*b* on for instance parallelogrammatic linkages 13 upward and inward to the respective coil 6 and downward and outward away from them. The inner ends of the rods 12 are formed as upwardly directed hooks 12*a* for engaging and pulling off cut turns 6*a*.

The system operates as follows:

The two actuators 4 and 5 push the slide supports 2 and 3 into the station S from the outer position shown for slide 3 in FIG. 1 to the inner position shown for slide 2. The guide plates 17 grip the coil 6 and the wedges 15 are moved down to separate out a few outer turns 6*a* that are then cut by the respective shears 9 and 10. The cut turns 6*a* will drop down into the outlet chute 11.

In the arrangement of FIGS. 3, 4, and 6, after the cutting operation the two supports 2 and 3 are moved into their outer positions and the hook rods 12 are moved by their respective linkages 13 against the ends of the coil 6 in the station S and grab the outer turns 6*a*, lifting and pulling them. The lower portions of the cut turns 6*a* engage the hooks 12*a* so the cut turns 6*a* are pulled off the coil 6 and drop into the chute 11.

We claim:

1. In combination with a hook conveyor that passes a succession of coils having outer turns through a trimming station in a transport direction with each coil lying at the station in a plane generally parallel to the direction, a trimming apparatus comprising:

a pair of supports flanking the conveyor at the station and each movable between outer and inner positions;

respective guides on the supports defining respective vertical guide planes generally parallel to the direction;

respective shears movable on the guides long the respective guide planes; and means including respective actuators for displacing the shears along the respective planes and, in the inner positions of the respective supports, cutting the outer turns from a coil in the station.

2. The combination defined in claim 1, further comprising respective separating wedges displaceable on the guides; and means for displacing the wedges generally radially of the coil in the station to separate the respective outer turns from the coil.

3. The combination defined in claim 1, further comprising respective stripper rods carried on the supports and each displaceable between upper and inner positions engaging the coil in the station and lower and outer positions, whereby the rods pull the cut outer turns from the coil in the station on displacement from the respective inner to outer positions.

4. The combination defined in claim 3 wherein the rods have hooked inner ends.

5. The combination defined in claim 1, further comprising an upwardly open waste chute in the station between the supports.

6. The combination defined in claim 5 wherein the chute is formed by a pair of upwardly diverging plates.

7. The combination defined in claim 1 wherein a pair of such shears offset in the plane from each other are provided on each support.

8. The combination defined in claim 7 wherein the shears of each pair are asymmetrical with respect to the vertical.

* * * * *